US005112266A

United States Patent [19]

Hall

[11] Patent Number: 5,112,266

[45] Date of Patent: May 12, 1992

[54] NOISE MAKING DEVICE

[76] Inventor: Shirl F. Hall, 3585 Jefferson Rd., Ashtabula, Ohio 44004

[21] Appl. No.: 178,260

[22] Filed: Apr. 6, 1988

[51] Int. Cl.[5] ..... A63H 33/08; A63H 5/00; G10D 13/08; A44B 18/00

[52] U.S. Cl. ..... 446/422; 446/116; 446/125; 84/402; 24/442

[58] Field of Search ..... 446/422, 421, 418, 405, 446/404, 116, 121, 122, 125; 84/402; 24/442, 587, 576

[56] References Cited

U.S. PATENT DOCUMENTS

| | | | |
|---|---|---|---|
| D. 73,752 | 11/1927 | Marks | D21/65 |
| 1,890,288 | 12/1932 | Graf | 446/421 |
| 2,678,158 | 5/1954 | Arnt | 446/421 X |
| 3,157,000 | 11/1964 | Stavig | 446/418 |
| 3,170,360 | 2/1965 | Miettinen | 446/422 X |
| 3,444,772 | 5/1969 | Martin | 446/421 X |
| 3,495,306 | 2/1970 | Eichberg | 24/576 |
| 3,509,927 | 5/1970 | Hasty et al. | 24/587 X |
| 3,739,730 | 6/1973 | Horowitz | 446/125 X |
| 3,866,348 | 2/1975 | Roby et al. | 446/121 X |
| 3,909,977 | 10/1975 | Kirk | 446/418 |
| 4,103,451 | 8/1978 | Kawada et al. | 446/121 X |
| 4,266,459 | 5/1981 | Seregely | 84/402 |
| 4,305,221 | 12/1981 | Chatani | 446/121 |
| 4,385,467 | 5/1983 | Samuels | 446/121 X |
| 4,660,259 | 4/1987 | Ausnit | 24/587 |
| 4,810,228 | 3/1989 | Huggins | 446/418 |

*Primary Examiner*—Danton D. DeMille
*Assistant Examiner*—D. N. Muir
*Attorney, Agent, or Firm*—D. Peter Hochberg; Mark Kusner; Louis J. Weisz

[57] ABSTRACT

A noise making device for creating selective clapping sounds comprised of a pair of section halves of molded plastic construction, each section including a handle portion and an elongated flat blade portion extending therefrom together with locking elements for joining the section halves together along a planar mating surface, which locking elements are provided internally to define a smooth handle portion.

3 Claims, 2 Drawing Sheets

NOISE MAKING DEVICE

FIELD OF THE INVENTION

The present invention relates to a percussion type noise making device, and more particularly to a hand-held device for producing a slapping sound.

SUMMARY OF THE INVENTION

The present invention provides a novel noise producing device which finds advantageous application at sports events, parties, celebrations and the like.

In accordance with the present invention, there is provided a noise making device for creating selective clapping sounds comprised of a pair of sections of molded plastic construction. Each section includes a handle portion having a mating surface and an elongated, flat blade portion extending therefrom. Locking means are provided for joining one section to the other to form an integral unit having a handle wherein the blade portions of the respective sections extend therefrom juxtaposed at a predetermined angle relative to each other.

In accordance with another aspect of the present invention, there is provided a noise making device as described above wherein the locking means for joining the sections are contained internally within the defined handle.

It is an object of the present invention to provide a hand-held and actuated device for creating noise during sports events, celebrations and other audience participation activities.

Another object of the present invention is to provide a device as described above which may be operated with one hand and non-injurious contact with the body.

Another object of the present invention is to provide a device as described above wherein the device is formed from two identical sections.

A still further object of the present invention is to provide a device as described above wherein the means for joining the sections are located internally within the device.

A still further object of the present invention is to provide a device as described above which is light weight, inexpensive to manufacture and assemble, and easy to use.

These and other objects and advantages of the device will become apparent from the following description of a preferred embodiment of the invention taken together with the accompanying drawings.

DRAWINGS

The invention may take physical form in certain parts and arrangement of parts, an embodiment of which is described in detail in the specification and illustrated in the accompanying drawings wherein.

BRIEF DESCRIPTION OF PREFERRED EMBODIMENT

Figure 1:
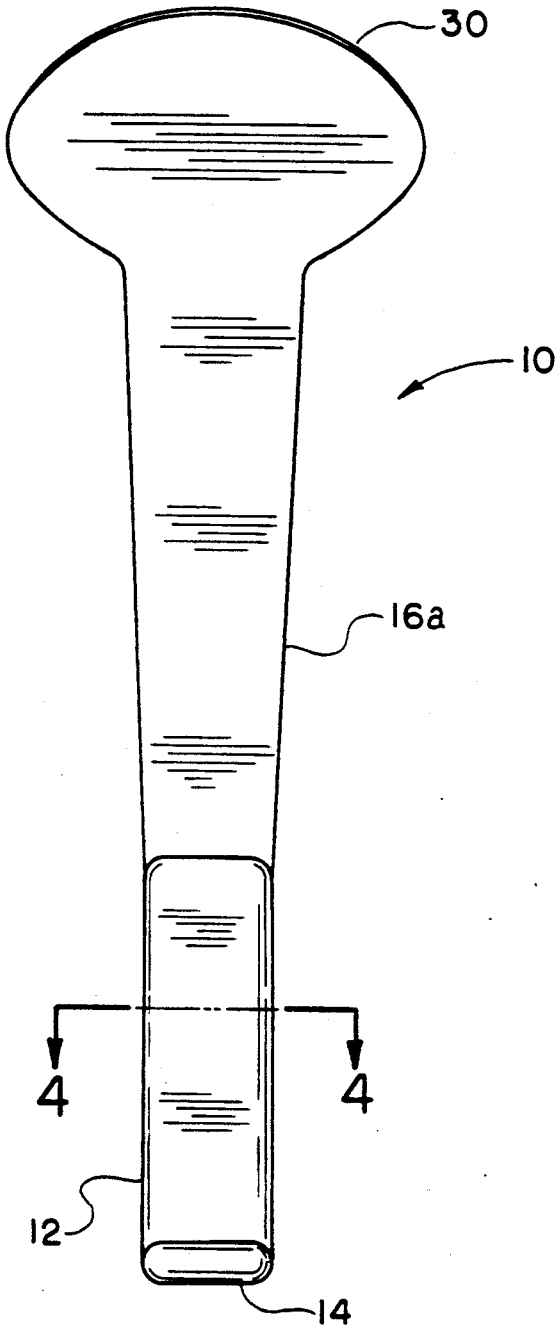
FIG. 1 is a front elevational view of a noise making device illustrating a preferred embodiment of the present invention.
Figure 2:
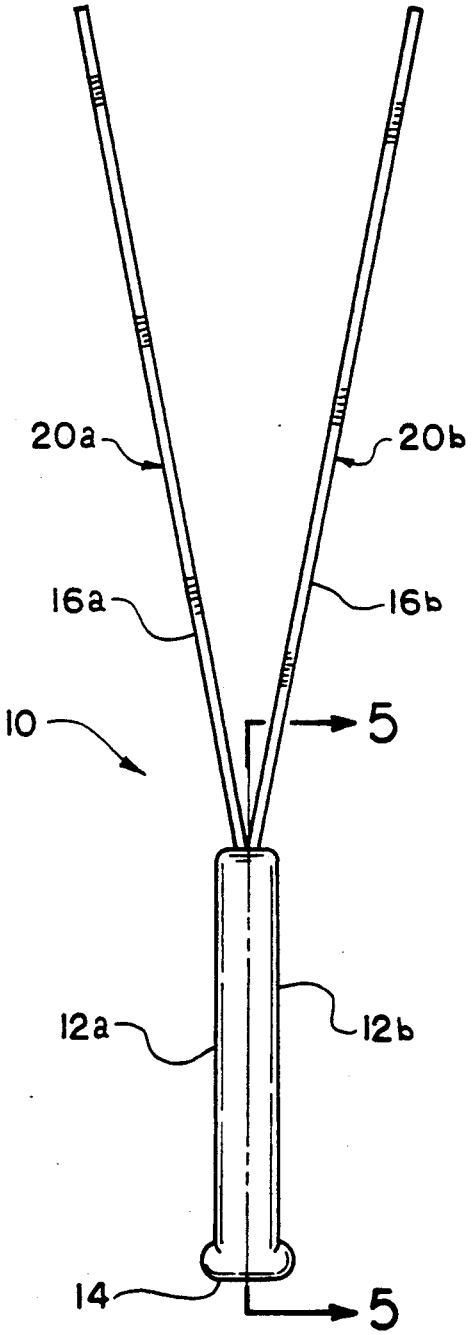
FIG. 2 is a side elevational view of the noise making device shown in FIG. 1.
Figure 3:
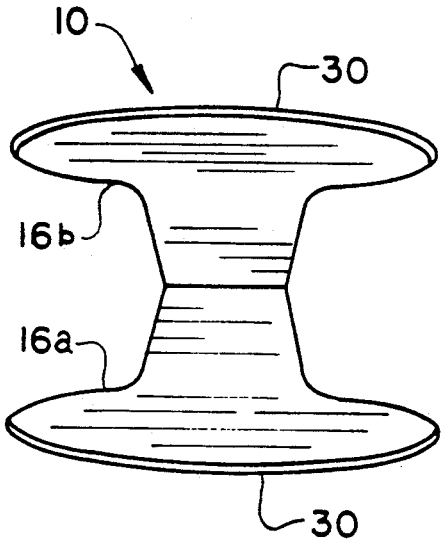
FIG. 3 is a top plan view of the noise making device shown in FIG. 1.

Referring now to the drawings wherein the showing are for the purpose of illustrating a preferred embodiment of the invention, and not for the purpose of limiting same, FIGS. 1, 2 and 3 illustrate a noise making device 10 according to the present invention. Noise making device 10 includes a defined handle 12 having a heel 14 and a pair of flat blades designated 16*a* and 16*b* extending therefrom. Blades 16*a*, 16*b* extend from handle 12 with a predetermined angle therebetween. The angle formed between blades 16*a* and 16*b* is preferably between 20° and 30° . According to the present invention, noise making device 10 is comprised of two generally identical section halves 20*a*, 20*b*. As best seen in FIG. 2, section half 20*a* includes blade 16*a* and a portion 12*a* of handle 12. In similar respects, section half 20*b* includes blade 16*b* and a portion 12*b* of handle 12. Each distal end of blades 16*a*, 16*b* includes an enlarged area 30 which generally forms the noise making portion of the device. Area 30 also provides a location on which advertisements promoting a specific product, company, name, logo, or sports team may be provided. Such name or logo may be applied as a decal, painted theron or embossed into the blade during forming. In this respect, area 30 may be configured to have a specific shape related to the advertisement or logo thereon. In the embodiment shown, area 30 has been configured to generally resemble a football, and thus could include a team name thereon. In similar respects, a circular area may be provided to represent a baseball, basketball or soccerball.

Figure 5:
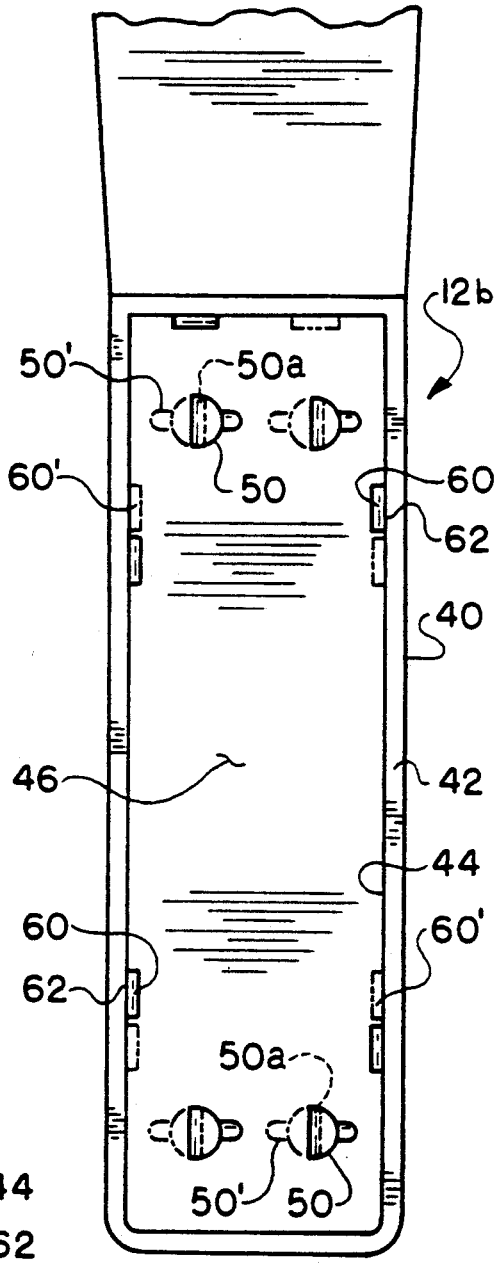
FIG. 5 is a view taken along line 5—5 of FIG. 2 showing the internal configuration of the handle portion of the device.
Figure 4:
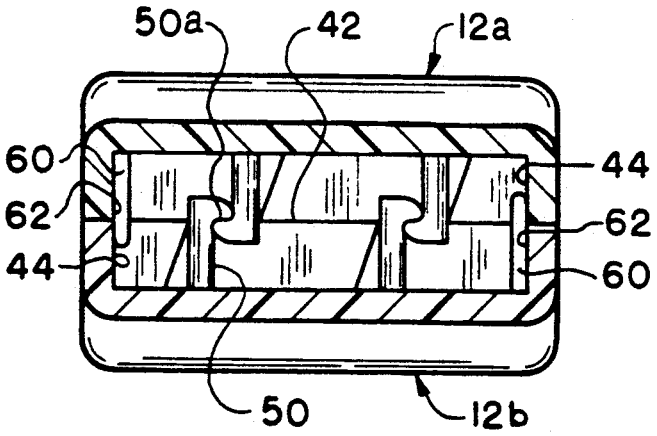
FIG. 4 is a sectional view taken along line 4—4 of FIG. 1.

Referring now to FIG. 5, a view of handle portion 12*b* is shown. Because section 12*a* and 12*b* are substantially identical, a description of section 12*b* will likewise describe the configuration of section 12*a*. Section 12*b* includes a wall 40 defining the periphery thereof. Wall 40 includes an upper surface 42 which comprises a mating or engagement surface along which sections 12*a* and 12*b* are joined. Wall 40 also includes an inwardly facing wall surface 44 which is generally perpendicular to mating surface 42. A cavity 46 is defined within handle section 12*b*. Sections 12*a* and 12*b* are joined by means of locking posts 50 within cavity 46. As best seen in FIG. 4, each post 50 is generally I-shaped and includes a locking lip 50*a*. Locking posts 50 extend from cavity 46 beyond the plane defined by mating surface 42. In this respect, locking lip 50*a* projects into the cavity of the opposing section half when joined therewith. Locking posts 50 are disposed within cavity 46 such that they engage similar members in the opposing section halves and become interlocked therewith in a conventionally known manner as shown in FIG. 4. In FIG. 5, locking posts 50′ (shown in phantom) of section half 12*a* illustrate the position of the locking posts when the respective section halves are joined.

To properly position section halves 20*a* and 20*b* relative to each other, positioning tabs 60 are provided within cavity 46 adjacent wall 40. As best seen in FIG. 4, positioning tabs 60 extend beyond the plane defined by mating surface 42 and include outwardly facing flat surfaces 62. Outwardly facing flat surfaces 62 are generally coplanar with inwardly facing surface 44 of wall 40. In this respect, when section halves 20*a* and 20*b* are joined, the upper end of positioning tabs 60 extend into cavity 46 of the opposing section half, wherein outwardly facing tab surface 62 thereof engages inwardly facing wall surface 44. Positioning tabs 60 thus prevent lateral displacement of the section halves relative to each other along mating surface 42 when the respective halves are joined. In FIG. 5, positioning tabs 60' (shown in phantom) illustrate the position of the positioning tabs of section half 20*a* when the respective sections are joined.

The present invention thus provides a light weight, attractive noise making device which is relatively easy to manufacture and assemble. In this respect, because section halves 20*a* and 20*b* are substantially identical, they may be formed from a single die mold, thereby reducing manufacturing costs. Likewise, the locking posts and positioning tabs are all disposed internally, within the handle of the device thereby providing a smooth, contoured handle portion and overall aesthetically pleasing device.

The present invention has been described with respect to a preferred embodiment. Modifications and alteration will occur to others upon their reading and understanding of the specifications. It is intended that all such modifications and alteration be included insofar as they come within the scope of the patent as claimed or the equivalents thereof.

I claim:

1. A noise making device for creating selective clapping sounds comprised of a pair of identical section halves of molded plastic construction, each section including:

a handle portion having a cavity formed therein, said cavity having a wall section extending about the periphery thereof, said wall section having a planar mating surface and an inwardly facing flat wall surface perpendicular to said planar mating surface, an elongated, flat blade portion extending from said handle portion diverging from said planar surface at a predetermined angle, positioning means for aligning respective mating surfaces of said section halves in registry with each other, and securing means for joining one section half to the other along said planar mating surface to form an integral unit having a defined handle with said blade portions extending therefrom juxtaposed at a predetermined angle relative to each other, said securing means being comprised of generally L-shaped posts positioned to engage in snap-lock fashion a corresponding post on the opposing member, and being disposed within said cavity such that when said section halves are joined said locking means are within said defined handle.

2. A noise making device for creating selective clapping sounds as defined in claim 1 wherein said device is made from a plastic material selected from the group consisting of PVC, ABS, Celcon, AST and Minlon.

3. A noise making device for creating selective clapping sounds comprised of:

a juxtaposed pair of elongated members of molded plastic construction each of said members being identical and including first and second ends, a flat blade portion at said first end of each of said members, means for maintaining a spacing between the blade portions of the juxtaposed members, means for securing said members together in snap-lock fashion at said second end of each of said members, said means for securing being integrally formed as part of said member to operatively engage portions of the opposing member, and said securing means comprised of at least two generally L-shaped posts positioned to engage in snap-lock fashion corresponding posts on the opposing member said posts within said second end and spaced apart from sidewalls of said second end and each other.

* * * * *